United States Patent [19]

Jansen

[11] Patent Number: 4,819,473

[45] Date of Patent: Apr. 11, 1989

[54] PRESS FORMING SHEET METAL

[75] Inventor: Matthys B. J. Jansen, Caringbah, Australia

[73] Assignee: Australian Design Marketing PTY., Ltd., Australia

[21] Appl. No.: 124,943

[22] PCT Filed: Dec. 8, 1986

[86] PCT No.: PCT/AU86/00373

§ 371 Date: Aug. 4, 1987

§ 102(e) Date: Aug. 4, 1987

[87] PCT Pub. No.: WO87/03518

PCT Pub. Date: Jun. 18, 1987

[30] Foreign Application Priority Data

Dec. 12, 1985 [AU] Australia ..... PH3851

[51] Int. Cl.[4] ..... B21D 5/04

[52] U.S. Cl. ..... 72/382; 72/397; 72/404

[58] Field of Search ..... 72/306, 307, 309, 382, 72/396, 397, 404

[56] References Cited

U.S. PATENT DOCUMENTS 1,341,721 6/1920 Opitz ..... 72/404
2,079,553 5/1937 Fraser ..... 72/396
2,712,340 7/1955 Sandberg ..... 72/397
2,847,053 8/1958 Hardman ..... 72/397

*Primary Examiner*—Lowell A. Larson
*Attorney, Agent, or Firm*—Ostrolenk, Faber, Gerb & Soffen

[57] ABSTRACT

A method of and apparatus for press forming sheet metal into articles, such as roof cladding element (10), having intersecting fold lines. A strip of metal is advanced through a forming die which has first (20) and second (21) stages and a press forming operation is performed on the metal strip in each stage of the die during each closing stroke of the die. One portion of the metal strip is formed in the second stage (21) of the die during a first time interval of each closing stroke of the die and a further portion of the metal strip is movably clamped in the first stage (20) of the die during the same time interval in order that it may be pulled into said second stage (21) of the die during the first time interval. During a second time interval of each closing stroke the metal strip is immovably clamped in both stages (20 and 21) of the die. The first stage (20) of the die is employed to preform longitudinally extending fold lines such as rib (12) and the second stage (21) employed to form transversely extending fold lines such as flutes (14) and channels (15).

10 Claims, 9 Drawing Sheets

10
14
15
65
66
67
68
71
72
73
80
81
82
83
84
92
95
96
97
98
99
100

PRESS FORMING SHEET METAL

TECHNICAL FIELD

This invention relates to a method of and apparatus for press forming sheet metal. The invention has particular application to progressive press forming of sheet metal articles which have intersecting form lines and which would require the application of very high press forces if they were to be shaped by conventional stretch-forming or drawing techniques.

BACKGROUND ART

In a typical progressive press forming operation a sheet or strip of metal is advanced through successive stages of a die and a desired final product shape is imparted to the metal in progressive stages. The metal is advanced between the stages whilst the die components are open and press forming of the metal is effected in each stage during each closing stroke. U.S. Pat. No. 4,309,889 discloses a typical progressive press forming operation.

A problem that exists in conventional progressive press forming is that, during a pressing operation, metal can be pulled from one direction only. This arises from the fact that in a two-stage progressive forming operation for example, metal cannot be pulled back to the first stage whilst it is being worked-on in the second stage and/or it cannot be pulled into the second stage whilst it is subjected to a press forming operation in the first stage. Thus, all metal which is to be pulled into the first stage must be provided from the input side of the tool and all metal which is required to be pulled into the second stage must be provided from the output side of the tool. This restricts the shaping which ca be applied to the metal and/or requires that the shaping be created by stretch-forming the metal. The latter approach requires expensive tooling and high powered presses.

U.S. Pat. Nos. 2,510,024 and 2,954,068 and British patent specification No. 1,398,027 disclose press tools which operate in a manner such that metal is pulled into the tools from two directions during formation of longitudinally extending corrugations. However, the tools which are disclosed in the referenced patent specifications cannot be used to form articles which have intersecting form lines.

DISCLOSURE OF THE INVENTION

The present invention distinguishes over prior art press forming arrangements in that it is directed to a press forming method which is suitable for shaping sheet metal articles which have intersecting fold lines. A strip of the sheet metal is advanced through a multistage die and a forming operation is effected in each stage of the die during each closing stroke of the die. During a first time interval of each closing stroke. Press forming is effected in one stage of the die whilst metal in the or each other stage is movably clamped. whereby metal can be pulled into said one stage from the or each other stage of the die. Then, during a second time interval of each closing stroke, the metal is immovably clamped in all stages of the die.

Because the metal in the further stages of the die is not clamped during the initial time interval of each closing stroke and because the metal may then be pulled into the stage in which press forming is being effected. complex press forming operations may be effected in the die without the need for very high die closing forces.

The invention may also be defined as providing an apparatus in the form of a metal press forming die. The die includes multiple stages through which a strip of metal is advanced and in which forming operations are effected during each closing stroke of components of the die. The die components are arranged such that, during a first time interval of each closing stroke, press forming is effected in one stage of the die whilst metal in the or each other stage is movably clamped, whereby the metal can be pulled into said one stage from the or each other stage of the die. Additionally, the die components are arranged such that, during a second time interval of each closing stroke, the metal is immovably clamped between the die components of all stages of the die.

The invention will be more fully understood from the following description of two (alternative) press forming dies which incorporate preferred features of the invention. The description is provided with reference to the accompanying drawings.

MODES FOR CARRYING OUT THE INVENTION

Figure 1:
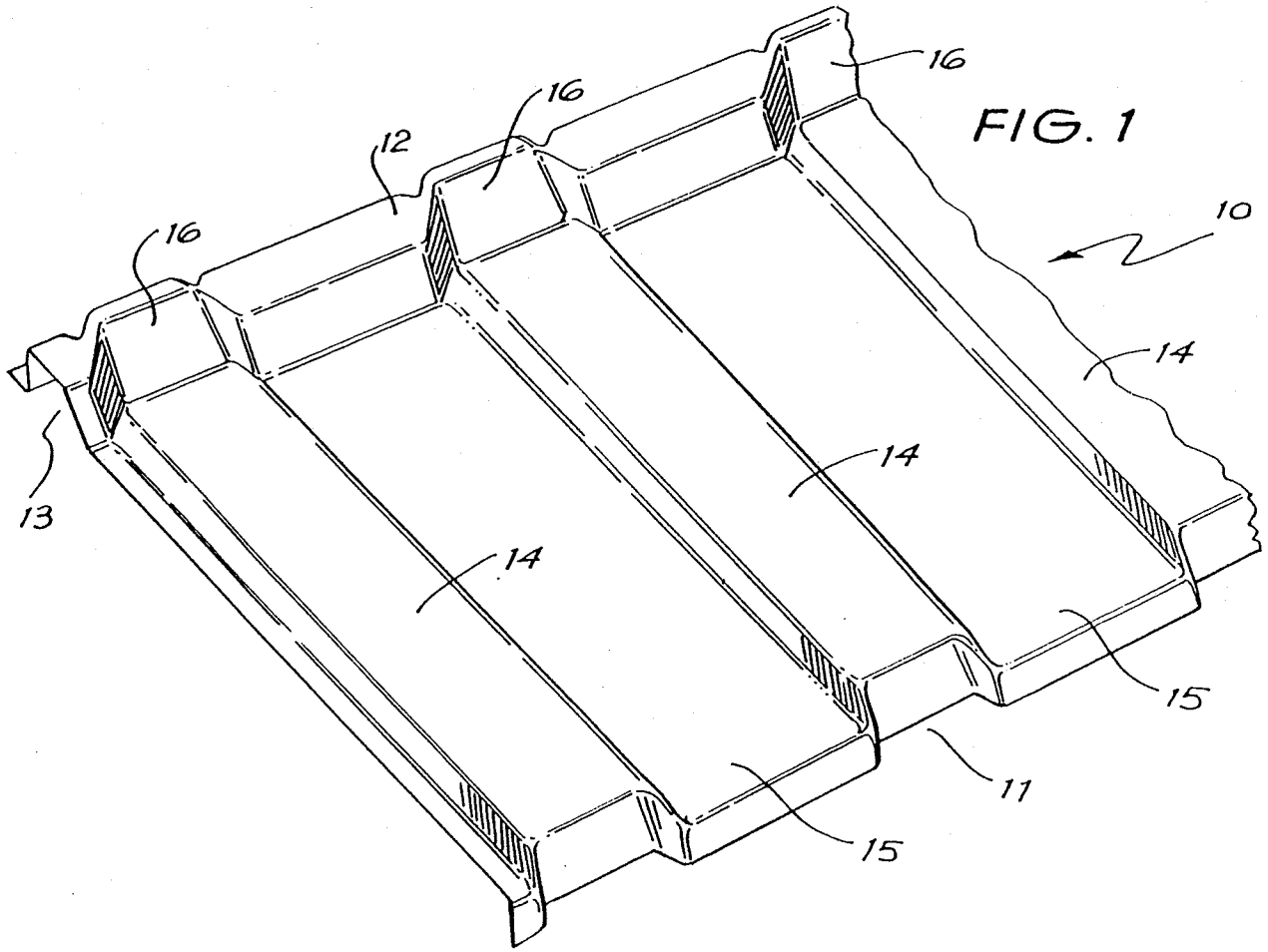
FIG. 1 shows a perspective view of a portion of length of sheet metal roof cladding.
Figure 2:
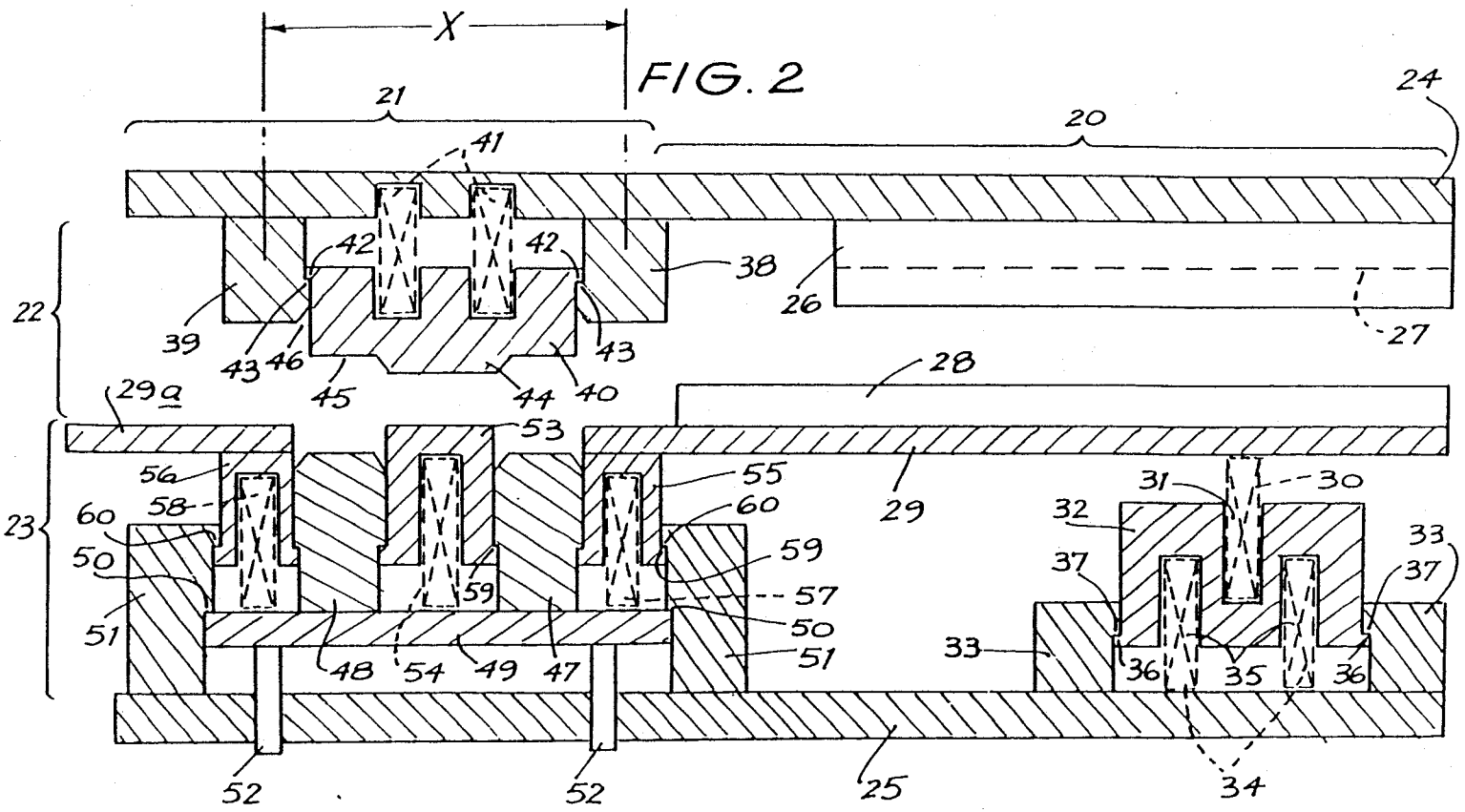
FIG. 2 shows in a partially schematic way a sectional elevation view of a two-stage die which may be employed in forming the cladding element of FIG. 1, the die havinq upper and lower die components illustrated in an open condition.

As shown in FIG. 1, the cladding element 10 is formed from sheet metal and it has a panel portion 11 which extends forwardly from a rib 12. The rib 12 is formed as an inverted channel 13 which extends along the full length of the cladding element, and the panel 11 is formed with a series of flutes 14 which extend transversely with respect to the rib 12. The flutes 14 are separated by parallel channels 15 and the flutes extend into recesses 16 within the wall of the rib 12.

The cladding element may be formed from a strip of flat sheet metal which is wound from a coil, the cladding element having a length in the order of 6 meters and a width in the order of 0.5 meter.

Due to the fact that the rib 12 and the flutes 14 have intersecting fold lines, the cladding element cannot be produced using roll-forming techniques. Also, it would not be convenient to press form the cladding element by conventional stretch-forming and drawing procedures, due to the high capital costs that would need be expended on suitable tooling and due also to the high press power that would be required to stretch-form and draw the metal. However, the cladding element as shown in FIG. 1, and other sheet-metal elements. may be shaped relatively conveniently in press forming dies of the types illustrated in FIGS. 2 to 6 and 7 to 9.

The table 29 is carried at one end by a compression spring 30 which locates within a pocket 31 in a pressure pad 32. The pressure pad 32 is, in turn, carried in guide blocks 33 which are fixed to the lower bolster 25, and the pressure pad 32 is carried by springs 34. The springs locate in pockets 35, bear on the bolster 25, and bias the pressure pad 32 in an upward direction. The pressure pad 32 is formed with shoulders 36 which engage with ledges 37 in the guide blocks to limit the maximum extent of upward movement of the pressure pad.

The second stage 21 of the upper die component 22 comprises a two spaced-apart fixed punches 38 and 39 and an intermediate spring-loaded punch 40. The spring-loaded punch is biased in a downward direction by compression springs 41, and its lower limit of movement is determined by shoulders 42 engaging with ledges 43 on the fixed punches 38 and 39.

The lower end of the spring-loaded punch 40 is formed with a projection 44 which is shaped to match the channel 15 in the cladding element. Also, side shoulder portions 45 of the punch 40 co-operate with chamfered edges 46 of the fixed punches 38 and 39 to provide a shape (see FIGS. 4 to 6) which matches the cross-sectional shape of the flutes 14 in the cladding element.

The second stage 21 of the lower die component 23 has two fixed punches 47 and 48 which are carried by a platform 49. The platform 49 is movable between an upper fixed position (FIG. 2), which is determined by ledges 50 in spaced-apart guide blocks 51, and a lower position (FIG. 6) where it contacts the lower bolster 25. pneumatic/hydraulic rams 52 are employed for driving the platform between the upper and lower positions, and this aspect of the die is to be hereinafter described in more detail.

As illustrated in FIGS. 2 to 6, the complete die assembly includes two stages 20 and 21 through which a sheet metal strip (not shown) is advanced from right to left. An elementary longitudinally extending, inverted U-shaped channel is preformed in the metal strip whilst it is resident in the first stage 20, and the preformed portion of the strip is then advanced into the second stage where final shaping is effected. That is, in forming the cladding element 10, an elementary shape of the rib 12 is preformed in the first stage 20 of the die whilst the flutes 14 and channels 15 are formed progressively in the second stage 21 of the die. Final shaping of the rib 12 and formation of the recesses 16 also is effected in the second stage of the die, during formation of the flutes 14, but the die elements which are employed for this purpose have been omitted from the drawings in the interest of avoiding excessive complication.

The complete die assembly as shown in FIGS. 2 to 6 comprises upper and lower die components 22 and 23 which are mounted to upper and lower bolsters 24 and 25 respectively. The complete assembly is arranged to be mounted in a conventional reciprocating press in the usual way but particulars of the mounting arrangement are not shown.

The first stage 20 of the upper die component 22 comprises a longitudinally extending fixed punch 26 which is formed along its full length with an inverted U-shaped channel 27. This mates with a spring-loaded movable punch 28 which is carried by a table 29, the punch and table 28 and 29 forming a portion of the lower die component 23 in the first stage 20 of the die assembly.

The fixed and movable punches 26 and 28 co-operate with one another to preform the channel 13 of the cladding element during closing of the die.

A spring-loaded pressure pad 53 is located between the fixed punches 47 and 48, the pressure pad 53 being biased in an upward direction by compression spring 54. Two further spring-loaded pressure pads 55 and 56 are located outside of the fixed punches 47 and 48 and they too are biased in an upward direction by springs 57 and 58. The upward extent of movement of the pressure pads is limited by shoulders 59 which contact ledges 60, and the downward limit of movement is determined by the platform 49.

The pressure pad 55 supports the inner end of the table 29 and the pressure pad 56 carries an extension **29*a* of the table. The upper surface of the pressure pad 53 normally is located in the same plane as the table 29, 29*a***.

The illustrated punches and pressure pads in the second stage 21 of the die are configured to form two flutes 14 and one spacing channel 15 in the cladding element of FIG. 1 during a single closing stroke of the die components 22 and 23. Also, although not shown in the drawings, final shaping of the rib 12 is effected in the second stage of the die components 22 and 23, and a preceding portion of the length of the rib is preformed in the first stage of the die during the same closing stroke. Thereafter, the die components are opened, the metal strip is advanced to locate the preformed rib in the second stage of the die, and the die components are again closed. This procedure is now described in greater detail with reference to FIGS. 2 to 6.

When the die components 22 and 23 are fully open (following a preceding closing-opening stroke) a metal strip is advanced through the die such that a portion of the strip that previously was press-formed to its final shape in the second stage 21 is moved out from the die. In fact. the strip is advanced by an amount slightly greater than the distance X shown in FIG. 2, and two preforming pressing operations are performed on a given length of metal during the time that it is moving toward the second stage 21 of the die.

Figure 3:
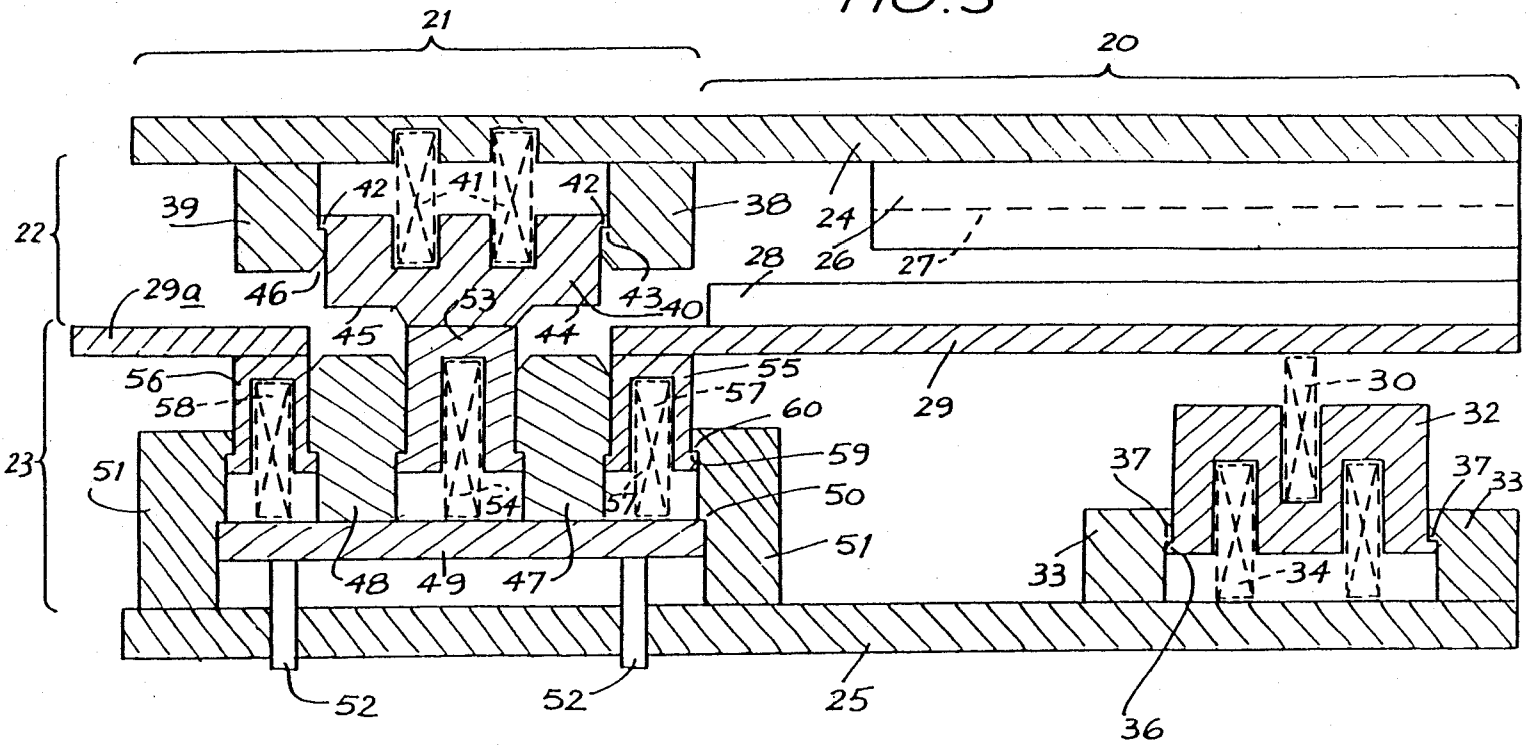
FIGS. 3 to 5 illustrate the two-stage die of FIG. 2 with the upper and lower die components in successive operational positions during a closing stroke of the die.

When the metal strip had been advanced by the required amount. the die components 22 and 23 are brought together during an initial part of the closing stroke. This condition is indicated in FIG. 3, with the spring loaded punch 44 and the pressure pad 53 just touching the metal strip. However, the metal strip had been omitted from the drawings in the interest of clearly showing the interrelationship of the various die components.

Figure 4:
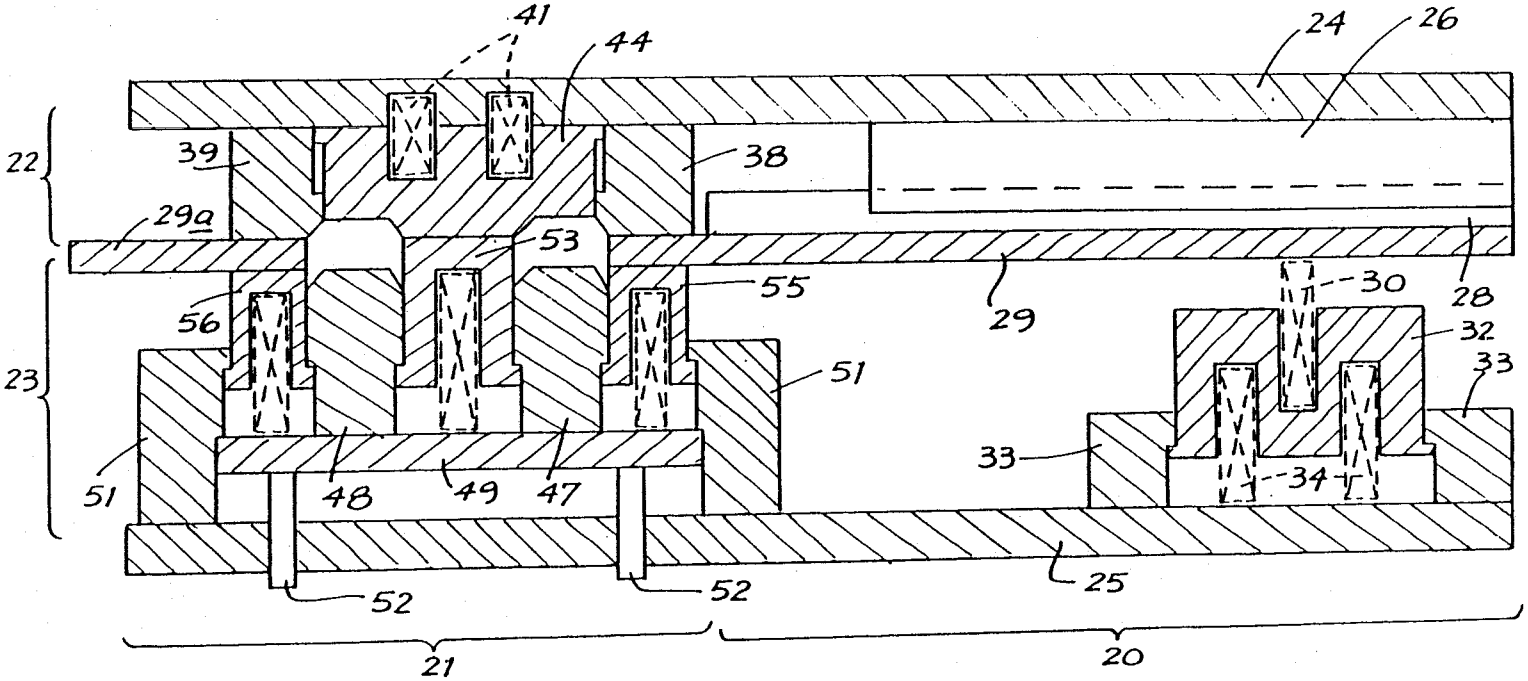

During the next stage of the closing stroke, that is during the transition between the condition shown in FIGS. 3 and 4, the fixed and movable punches 26 and 28 in the first stage 20 of the die are brought together. However. the metal then between the punches 26 and 28 is not immovably clamped because the movable punch 28 is resiliently supported by the springs 30 and 34. During the time that the initial preforming of the metal is occurring between the punches 26 and 28, the metal in the second stage 21 is more positively clamped between the punches 44 and 53. This occurs due to the compression of the springs 41. At the same time, the fixed punches 38 and 39 move toward the table portions 29 and 29a which are carried by the pressure pads 55 and 56.

Figure 5:
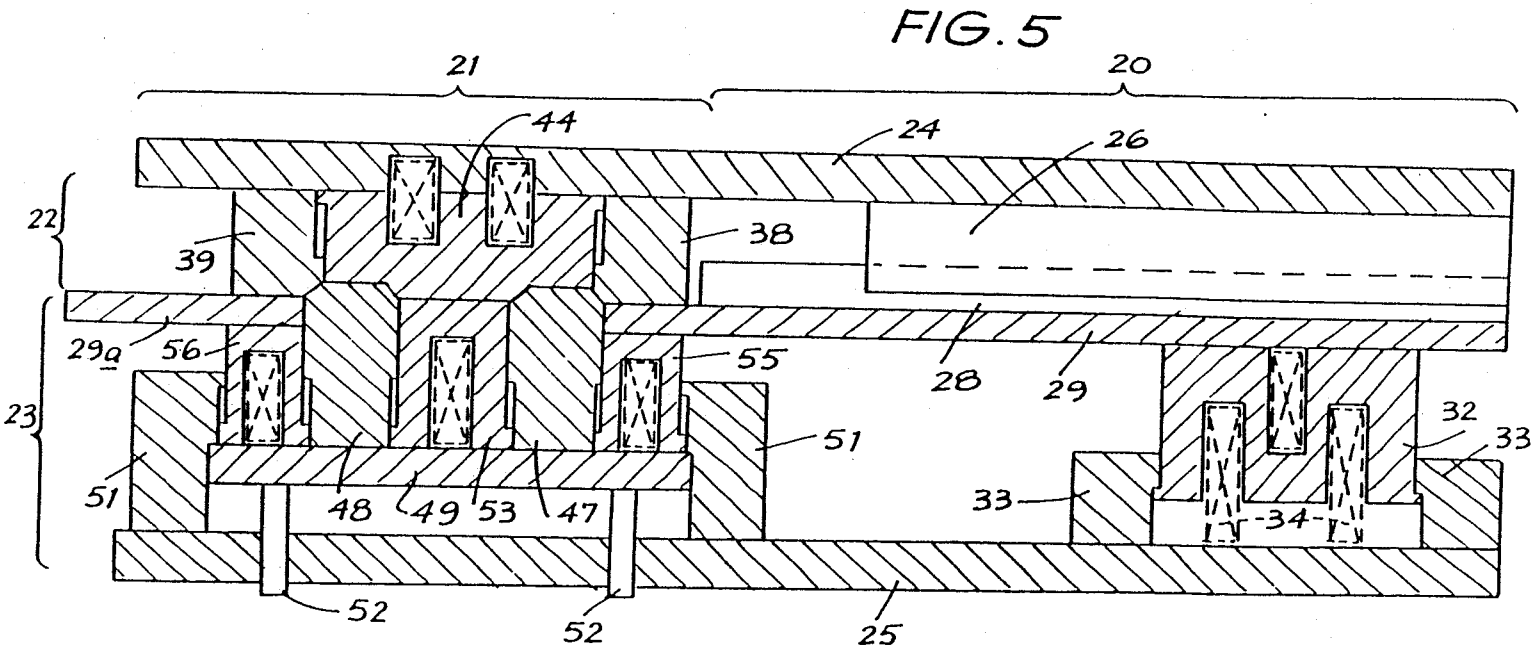
Figure 6:
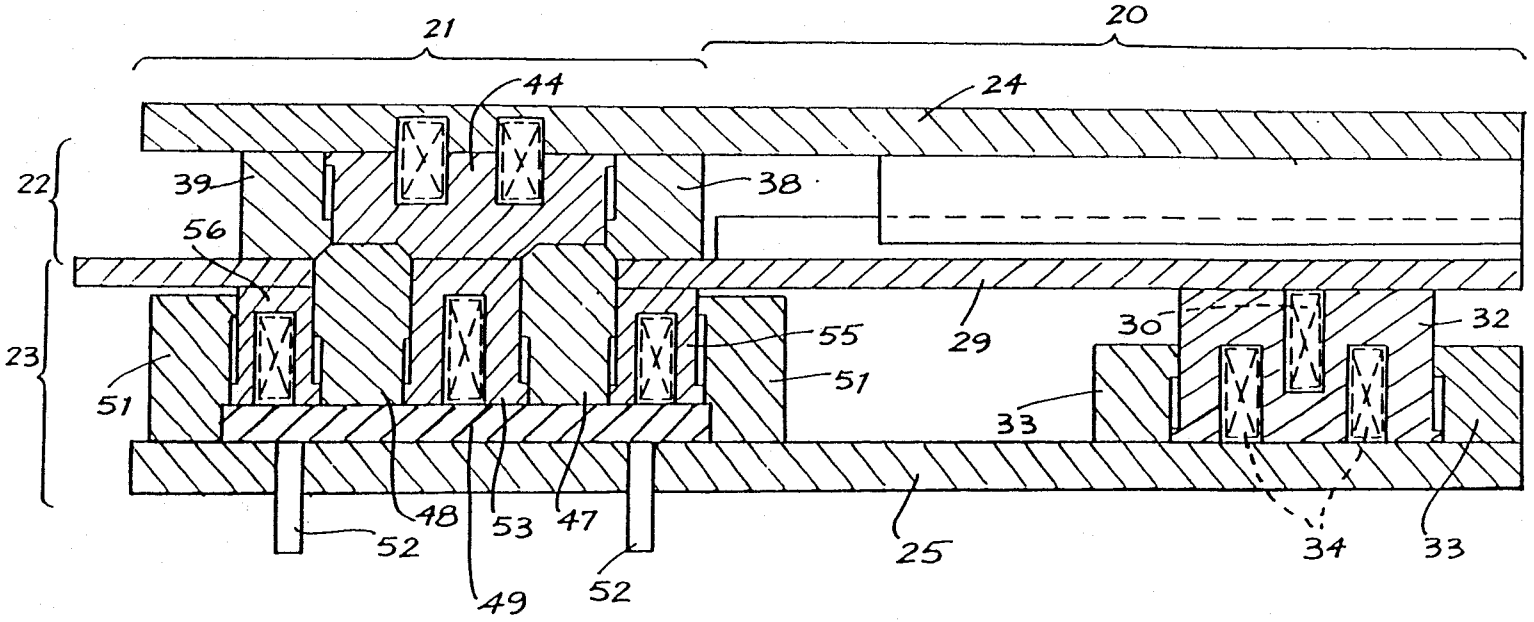
FIG. 6 shows the two-stage die of FIG. 2 with the upper and lower die components in a fully closed condition.

Then, during further closing of the die, between the conditions shown in FIGS. 4 and 5, all of the die components in the second stage 21 of the die are brought together to effect complete forming of the metal in the second stage of the die. Thus, the pressure pads 53, 55 and 56 are moved downwardly against their supporting springs and against the platform 49.

This results in formation of the two flutes 14 and one intermediate channel 15 (FIG. 1) in the strip and although not shown in the drawinqs in the final shaping of the rib 12 in the strip. However, as previously mentioned, the metal strip is not stretch-formed or drawn to any significant extent during this operational stage. Rather, a portion of the metal which previously was moved out of the die is pulled back into the die and at the same time, a portion of the metal which is resident in the first stage 20 of the die is pulled into the second stage 21. That is, metal is pulled from two (opposite) directions to accommodate shaping of the cladding element, and this occurs as a result of the pressure pad 32 in the first stage of the die being resiliently supported on the springs 34.

Thus, during a first time interval of each closing stroke of the die, the metal strip is movably clamped between the die component in the first stage 20 and the metal is pulled into the second stage 21 of the die. However, during the final stage of the closing stroke, whilst moving from the condition shown in FIG. 5 to that shown in FIG. 6, the rams 52 are activated and the platform 4 closes against the lower bolster 25. At the same time, the pressure pad 32 moves against its springs and the preforming operation in the first stage of the die is completed. Thereafter, the die components reopen to the condition shown in FIG. 2, the metal strip is advanced by an amount slightly greater than distance X (FIG. 2) and the cycle is repeated.

In the case of some articles, it may be necessary to shape a portion of the article in a first stage of the die and then. after advancing the material by one stage, hold that shape in the second stage of the die whilst a further shaping operation is effected in the second stage. A die arrangement which is suitable for this purpose is shown in FIGS. 7 to 9 of the drawings.

Figure 7:
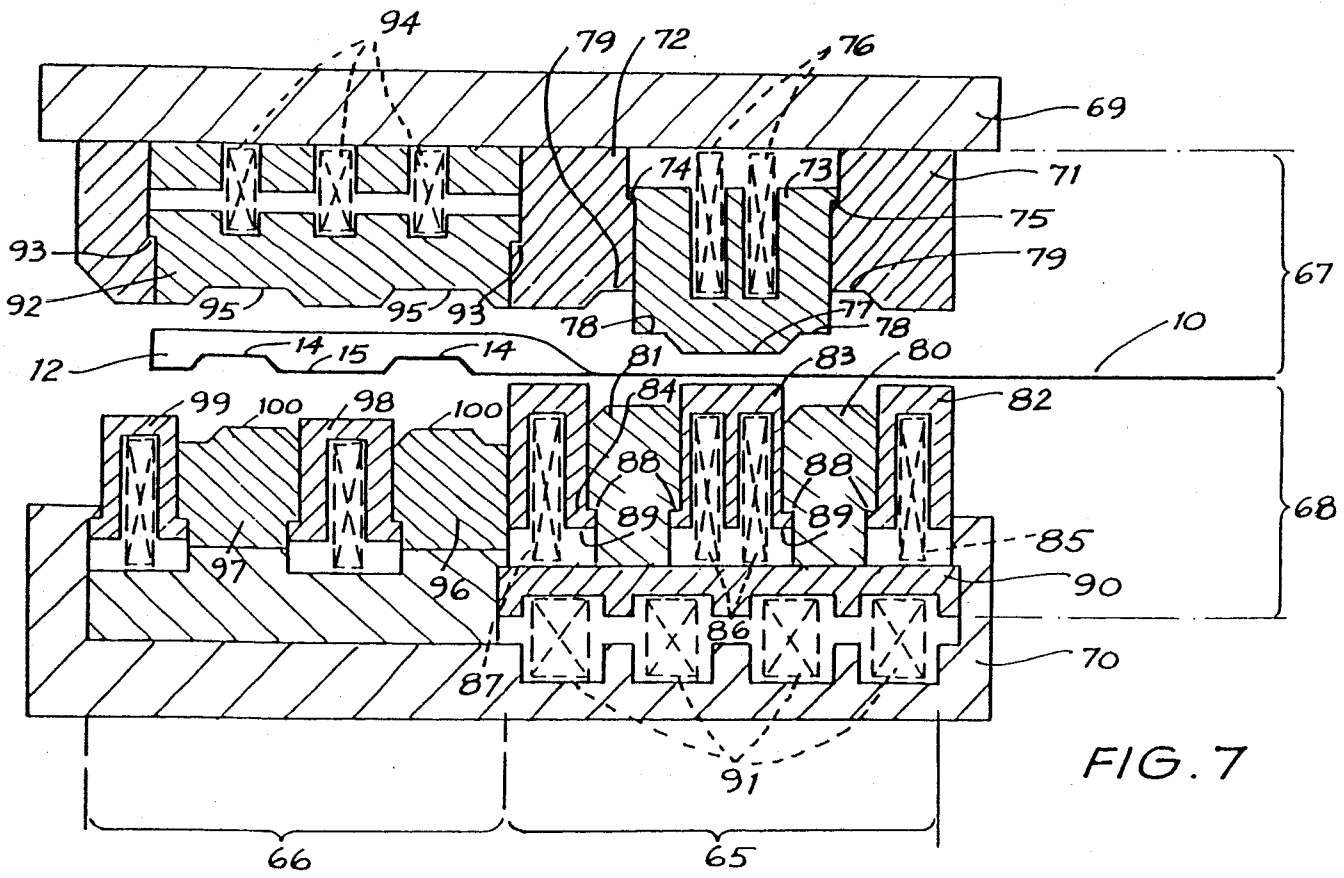
FIG. 7 shows also in a schematic way, an elevation view of a further two-stage die which may be employed for producing the cladding element of FIG. 1, with upper and lower components of the die shown in an open condition.
Figure 8:
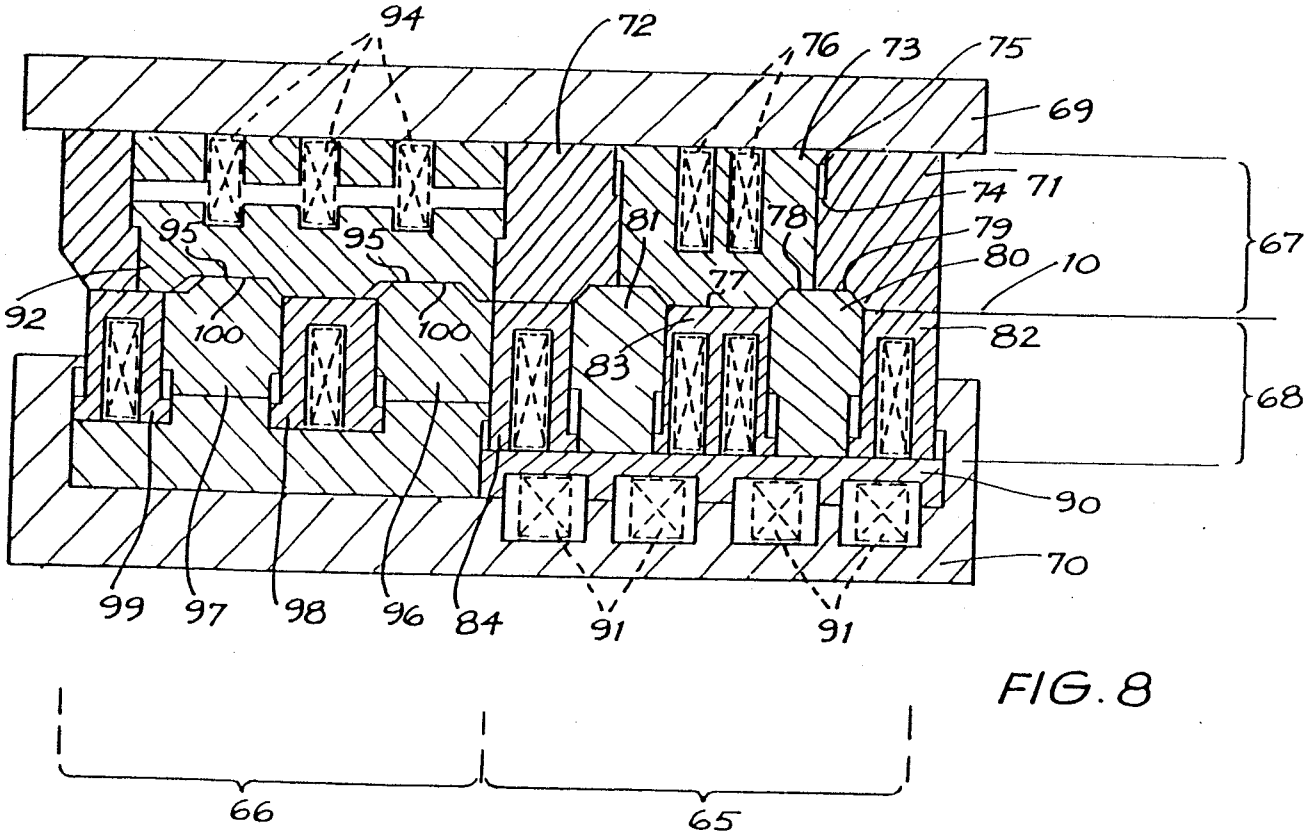
FIG. 8 shows an elevation view of the die of FIG. 7 but with the upper and lower die components in a fully closed condition.

A illustrated in FIGS. 7 and 8, the complete die assembly includes two stages 65 and 66 through which the metal strip 10 is advanced. The transverse flutes 14 are formed in the metal strip whilst it is resident in the first stage 65 and the metal strip is then advanced into the second stage 66 where. during the final phase of a closing stroke, the previously formed flutes 14 are clamped in a fixed position. Once so clamped, further press forming operations (not shown) may be imposed on the metal strip 10 in the second stage 66.

The die assembly comprises upper and lower die components 67 and 68 which are mounted to upper and lower bolsters 69 and 71 respectively. As in the case of the first embodiment of the invention, the complete die assembly is arranged to be mounted in a conventional reciprocating press in the usual way.

The first stage 65 of the upper die component 67 comprises two spaced apart fixed punches 71 and 72 and an intermediate spring loaded punch 73. Each of the fixed punches 71 and 72 is formed with a ledge 74 and the spring-loaded punch 73 is formed with shoulders 75. Compression springs 76 normally force the punch 73 in a downward direction and the degree of downward movement of the punch is limited by the shoulders 75 engaging with the ledges 74.

The lower end of the spring-loaded punch 76 is formed with a projection 77 which is profiled to shape the channel regions 15 between successive pairs of flutes 14 in the metal strip 10. Also, the spring-loaded punch 73 is formed with side shoulders 78 which co-operate with complementary shoulder portions 79 in the fixed punches 71 and 72 to shape the flutes 14.

The first stage 65 of the lower die component 68 comprises two fixed bending inserts 80 and 81 which align with the shoulder portion 78 and 79 of the upper die components, and the bending inserts 80 and 81 act in the press forming of the flutes 14. The channel regions 15 between the flutes 14 are contacted by pressure pads 82, 83 and 84 which are loaded and biased in an upward direction by compression springs 85, 86 and 87.

The bending inserts 80 and 81 are formed with ledges 88 which are engaged by shoulders 89 on the pressure pads 82 and 84 and which function to limit the upward extent of movement of the pressure pads.

The whole first stage 65 of the lower die component 68 is carried on a platform or support 90 which, in turn, is supported above the bolster 70 by four cushions 91. The cushions 91 are designated by springs in the drawings but, in fact, they would normally be constituted by pneumatic-hydraulic ram arrangements. The cushions 91 are normally extended, as shown in FIG. 7, so as to be elevated with respect to the bolster 70. However, at a critical time in the closing stroke of the die, the cushions 91 are collapsed to allow the platform 90 to move downwardly onto the bolster 70. This final position is shown in FIG. 8, The second stage 66 of the upper die component 67 comprises a single pressure pad 92 which normally sits at one level (determined by ledges 93) with respect to the fixed punches 71 and 72 in the first stage 65 of the die construction. However, the pressure pad 92 in the second stage may move upwardly against the springs 94 to accommodate any irregularities in the metal strip 10. The pressure pad 92 is formed with recesses 95 which align approximately with the preformed flutes 14 in the strip lo but, for reasons which will become clearer later in this description, the recesses 95 have a width greater than that of the flutes 14.

The second stage 66 of the lower die component 68 comprises two fixed inserts 96 and 97, and two spring-loaded pressure pads 98 and 99.

The fixed inserts 96 and 97 have projections 100 which fit neatly within the flutes 14 in the metal strip 10 and, thus, the projections 100 have a width which is significantly narrower than the recesses 95 in the upper pressure pad 92.

The lower fixed inserts 96 and 97 and the pressure pads 98 and 99 are shaped to complement and co-operate with the upper pressure pad 92, and they function to clamp the metal strip in a fixed position just prior to and during complete closure of the die components. This closed condition is shown in FIG. 8.

The operation of the die is now described with reference to FIGS. 9A to 9D of the drawings, which illustrate the positions of the various die components during successive stages of a single closing stoke.

Figures 9A, 9B, 9C, 9D:
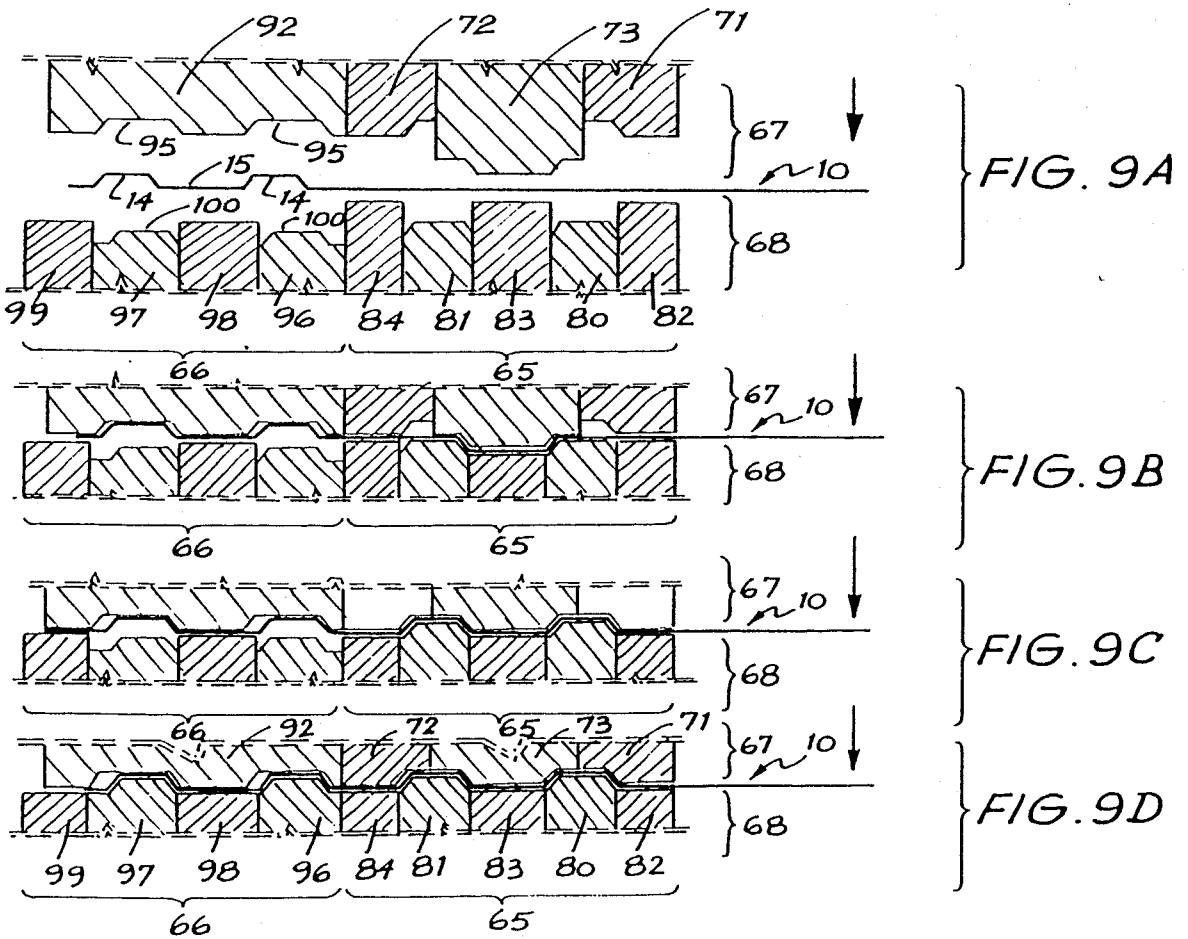
FIGS. 9A to 9D show successive operational stages of the die of FIGS. 7 and 8 during a closing stroke.

FIG. 9A shows the various die components in the condition which is illustrated in FIG. 7. That is, the upper movable die component 67 is elevated (i.e., open)

with respect to the lower substantially fixed die component 68. Additionally, the pre-formed end of the metal strip 10 is shown to have been advanced into the second stage 66 from the first stage 65, so that a second group of two flutes 14 can be formed in the strip, and the upper die component 67 has just commenced (or is about to commence) its downward stroke.

In the condition shown in FIG. 9A, the metal strip 10 is advanced into the second stage 66 to such an extent that the flutes 14 align with the left-hand end of the recesses 95, but are displaced to the left of the projections 100 of the fixed inserts 96 and 97. The strip advancing mechanism (not shown) effects this excessive advancement so that, as the strip subsequently is press formed in the first stage 65, the strip can be pulled into the first stage from both the left hand and the right-hand directions.

As the upper die component 67 continues its downward movement to the position shown in FIG. 9B, the spring loaded punch 73 engages the strip 10 and, initially, clamps the strip onto the (lower) pressure pads 82, 83 and 84. Thereafter, with continued downward movement of the upper die component 67 the (upper) punch 73 and the (lower) pressure pad 83 move against their respective springs and, at the same time, act on the metal strip 10 to press form the region 15 between the flutes 14.

As pressing of the strip and formation of the region 15 occurs, as shown in FIG. 9B, the metal strip 10 is pulled into the first stage 65 of the die from both the right-hand and left-hand directions. Thus, as illustrated in FIG. 9B, the previously formed flutes 14 move to the right within the recesses 95 in the pressure pad 92. This movement can occur because, again as shown in FIG. 9B, the level of the lower die component 68 in the second stage 66 is below that of the lower die component in the first stage 65. This condition exists, as indicated in FIG. 7 of the drawings, as a result of the platform 90 being elevated by the cushions 91 with respect to the bolster 70.

With further closing movement of the die components, to the condition shown in FIG. 9C, the punch 73 and the pressure pads 82, 83 and 84 move to the limit of their travel. As a consequence, a further pair of flutes 14 is formed in the strip 10 in the first stage 65 of the die. At the same time, the pressure pad 92 in the upper die component of the second stage 66 moves down toward the lower die components 96 to 99 and, with final press-forming of the flutes 14, the portion of the metal strip 10 in the second stage 66 is pulled further to the right, so that the flutes 14 in the second stage align with the fixed inserts 96 and 97 in the second stage.

In moving from the condition shown in FIG. 9C to that shown in FIG. 9D, the cushions 91 (FIGS. 7 and 8) are collapsed and the platform 90 moves toward the lower bolster 70. This allows the whole of the first stage 65 of the lower die component 68 to drop down to the level of the lower die component in the second stage 66 and, as the die completes its closing stroke, the whole of the upper die component 67 is closed against the lower die component 68. Thus, in moving from the condition shown in FIG. 9C to that shown in FIG. 9D, the whole of the metal strip 10 is clamped in the two stages of the die and secondary pressing operations (not shown) may be performed in the second stage of the die.

Thereafter, on a return stroke, the die components re-open to the condition shown in FIG. 9A, the strip 10 is advanced so that the newly formed flutes 14 are located within the second stage 66 of the die, and the above described closing operation is repeated.

I claim:

1. A method of press forming sheet metal wherein a trip of the metal is progressively advanced through a multi-stage die and a forming operation is effected in each stage of the die during each closing stroke of the die, wherein, during a first time interval of each closing stroke, one portion of the metal strip is press formed in one stage of the die whilst a further portion of the metal strip is movably clamped in the or each further stage of the die, and wherein, during a second time interval of each closing stroke, the metal strip is clamped substantially immovably in all stages of the die.

2. The method as claimed in claim 1 wherein partial press forminq of the metal strip is effected in the or each further stage of the die during the first time interval of each closing stroke as a consequence of the metal strip being movably clamped in the or each further stage.

3. The method as claimed in claim 1 wherein, during the first time interval of each closing stroke, said one portion of the metal strip is press formed in a second stage of the die whilst said further portion of the metal strip is preformed in a first stage of the die, the preformation of the metal strip being effected as a result of the metal strip being movably clamped between components of the die in the first stage.

4. The method as claimed in claim 3 wherein said preformation of the metal strip in the first stage of the die is effected at an angle parallel to the direction of advancement of the metal strip between the die stages.

5. The method as claimed in claim 1 wherein, during the first time interval of each closing stroke, said one portion of the metal strip is press formed in a first stage of the die whilst said further portion of the metal strip is movably clamped in a second stage of the die, and wherein the metal strip is subjected to a further press forming operation in the second stage of the die during the second time interval.

6. A press forming die comprising multiple die stages through which a strip of metal is in use progressively advanced, each stage of the die having upper and lower die components which are movable toward one another and which are arranged to effect a forming operation on the metal strip during each closing stroke of the die, the upper and lower die components in one stage of the die being arranged to effect press forming of one portion of the metal strip during a first time interval of each closing stroke and the upper and lower components in the or each further stage of the die being arranged to clamp a further portion of the metal strip in a manner such that the metal strip is movable in a direction toward said one stage of the die during the first time interval of each closing stroke, and the die components in each stage of the die being further arranged such that, during a second time interval of each closing stroke, the die components clamp the metal strip substantially immovably in all stages of the die.

7. The press forming die as claimed in claim 6 wherein the die components in the or each further stage of the die are arranged to effect partial press forming of the metal strip during the first time interval of each closing stroke.

8. A press forming die which comprises two stages through which a strip of metal is in use advanced, each stage of the die having upper and lower die components which are movable toward one another and which are arranged to effect a forming operation on the metal strip during each closing stroke of the die, the upper and lower die components in a second stage of the die being arranged to effect press forming of one portion of the metal strip during a first time interval of each closing stroke and the upper and lower die components in a first stage of the die being arranged to clamp a further portion of the metal strip in a manner such that the metal strip is movable in a direction toward the second stage of the die during the first time interval of each closing stroke, the die components in the first stage of the die being arranged to effect a preforming operation on the metal strip during the first time interval, and the die components in the first and second stages being further arranged such that, during a second time interval of each closing stroke, the die components clamp the metal strip substantially immovably in both the first and second stages of the die.

9. The press forming die as claimed in claim 8 wherein the upper and lower die components in the first stage of the die are profiled to effect a preformation of the metal strip in a direction parallel to that of advancement of the metal strip through the die.

10. The press forming die as claimed in claim 8 or claim 9 wherein the lower die components in both the first and second stages of the die include spring-loaded pressure pads which are biased in a direction toward the upper die components, wherein the die components in the second stage of the die are carried by a movable platform, and wherein means are provided for lowering the movable platform during the second time interval of each closing stroke of the die.

* * * * *